United States Patent [19]

Searles et al.

[11] Patent Number: 4,941,581

[45] Date of Patent: Jul. 17, 1990

[54] CONVERTIBLE CONTAINER AND VEHICLE

[75] Inventors: Charles W. Searles; Robert A. Searles; William S. Searles, all of Ontario, Canada

[73] Assignee: Searles Trailer and Equipment Ltd., Ontario, Canada

[21] Appl. No.: 55,272

[22] Filed: May 29, 1987

[51] Int. Cl.[5] ..... B65D 88/00

[52] U.S. Cl. ..... 220/1.5; 105/243; 105/282.1; 298/24

[58] Field of Search ..... 220/1.5; 105/243, 247, 105/282.1; 298/24, 27; 222/425, 453

[56] References Cited

U.S. PATENT DOCUMENTS

| | | | |
|---|---|---|---|
| 766,871 | 8/1904 | Brosnaw | 105/243 |
| 1,371,877 | 3/1921 | Dukes | 105/243 |
| 1,402,422 | 1/1922 | Hindahl | 105/243 |
| 2,465,244 | 3/1949 | Lutz . | |
| 2,775,480 | 12/1956 | Braswell et al. . | |
| 2,931,523 | 4/1960 | Nelligan | 220/1.5 |
| 3,027,197 | 3/1962 | Tripodi . | |
| 3,917,084 | 11/1975 | Swisher, Jr. et al. . | |
| 4,082,357 | 4/1978 | Schmidt et al. . | |
| 4,092,051 | 5/1978 | D'Orazio | 105/243 |
| 4,138,163 | 2/1979 | Calvert et al. | 220/1.5 |
| 4,534,596 | 8/1985 | Bonerb . | |
| 4,557,400 | 12/1985 | Clarke | 105/243 |

*Primary Examiner*—David T. Fidei

*Attorney, Agent, or Firm*—Rogers, Bereskin & Parr

[57] ABSTRACT

A convertible container has side walls, a rear door, front end walls sloping downwardly in the direction of the rear door, a floor commencing at the rear door, and a gated hopper lying between the floor and the front end wall. A movably mounted sheet has first and second positions, the first position of the sheet lying between the side walls, covering the hopper. In the second position the sheet is supported between the side walls, over the floor, sloping downwardly in the direction of the front end wall, and between the hopper and the rear door. The convertible container can be part of a convertible vehicle including a tractor, tilt mechanism for tilting the container between a tilted and a substantially horizontal position, wheels supporting the container, and a towing mechanism pivotally connecting the tractor and the front of the container. The hopper may be employed to discharge dry bulk goods when the sheet is in the second position and the container is in the substantially horizontal position. The rear door may be employed to discharge dry bulk goods or piece goods with the sheet in the first position and the container in the tilted position. The rear door may be employed to allow piece goods to be carried off with the sheet in the first position and the container in the substantially horizontal position.

26 Claims, 3 Drawing Sheets

CONVERTIBLE CONTAINER AND VEHICLE

FIELD OF THE INVENTION

This invention relates to convertible vehicles. More particularly, it relates to convertible trailers capable of bottom discharging and rear end discharging.

BACKGROUND OF THE INVENTION

It is well known that typical freight containers suffer from inflexibility in goods handling. Most trailers are capable of handling bulk goods or piece goods, but not both. As well the trailers which handle bulk goods are usually capable of only unloading those goods by either bottom discharging or end discharging, but not both.

The obvious advantage of trailers which are capable of more than one function is that the same trailer may be used to handle different types of cargoes. This flexibility enables the user to increase the efficiency of the trailer as the trailer would not be required to run empty in search of the single type of load it is capable of carrying.

The term "piece goods" as it is used herein includes discrete items which are commonly handled as individual pieces. The term "bulk goods" refers to known commonly tranported bulk granular material, which is generally free flowing so as to be capable of discharging by gravity action.

Convertible vehicles are known in the art. For example, U.S. Pat. No. 3,917,084 issued Nov. 4, 1975 to Swisher discloses a trailer assembly having a bottom dumping hopper. The hopper is capable of dumping bulk goods onto the ground, or onto a conveyor belt for discharging the bulk goods to the rear of the trailer from the conveyor. The Swisher device is complex in that it requires the use of the conveyor belt. The conveyor comprises many moving components which are susceptible to wear and failure. Further more, the rate at which rear discharging is carried out is dependant upon the speed and size of the conveyor belt. The Swisher vehicle is not capable of carrying and discharging piece goods.

U.S. Pat. No. 4,082,357 issued Apr. 4, 1978 to Schmidt describes a convertible vehicle body for transporting either piece goods or bulk goods. Hinged slope sheets at the ends of the body latch below the ceiling of the body or incline from the ceiling to form a continuation of hoppers contained in the floor. A grating over the hoppers supports piece goods or permits bulk goods to pass through its openings. The slope sheets are raised and lowered by a flexible belt hoist actuated from outside the body through chain and sprocket transmissions mounted under covers between pairs of vertical ribs.

The Schmidt device requires a hoist to raise the sloped sheets. The hoist must be maintained and is susceptible to wear and ultimate failure. The Schmidt patent does not refer to rear discharging of bulk goods.

In U.S. Pat. No. 4,534,596 issued Aug. 13, 1985 to Bonerb, there is disclosed a freight vehicle having a cargo space convertible from that suitable for handling piece goods to that suitable for handling bulk goods. A conventional cargo space has openings in the roof and floor for filling and discharging bulk material. A double wall inflatable bag having its bottom attached to a rigid support platform is positioned in erected condition to handle bulk material. It is movable to a stored position near the roof of the cargo space to handle piece goods.

The Bonerb vehicle requires complex winches and supports to move the rigid support platform from its erected to stored position. As well, a blower is required to inflate the bag and to cause the inner wall of the bag to move inwardly to assist the gravity discharge of the bulk goods. This is an unnecessarily complex and cumbersome system. The use of the bags does not allow for full use of the interior space in the trailer when hauling bulk goods. The Bonerb vehicle cannot end discharge bulk goods.

It is an object of the present invention to provide a vehicle capable of bottom and end discharging of bulk goods. It is an object of the invention to provide this convertibility in a vehicle which is relatively simple to manufacture without unnecessarily adding to the maintainence requirements and unnecessarily complicating the use of the vehicle.

It is a further object of the invention to provide a vehicle capable of bottom and end dumping of bulk goods and rear discharging of piece goods.

SUMMARY OF THE INVENTION

In accordance with the present invention there is provided a convertible cargo container, comprising: sidewalls; a rear end door movably mounted between the sidewalls; a front end wall extending between the sidewalls and sloping downwardly from the front of the sidewalls in the direction of the rear door; a floor extending between the sidewalls and forwardly from the rear door; a hopper means mounted between the floor and front end wall; a support means on the sidewalls for supporting a sheet above the floor; and a movably mounted sheet having first and second positions, in the first position the sheet lying between the sidewalls, covering the hopper means, and in the second position the sheet being supported on the support means between the sidewalls, sloping downwardly in the direction of the front end wall, and between the hopper means and the rear door.

In accordance with another aspect of the present invention there is provided a convertible vehicle for use with dry bulk goods and/or piece goods, the vehicle comprising: a tractor; a convertible cargo container defining sidewalls, a rear door movably mounted between the sidewalls; a front end wall sloping downwardly from the front of the sidewalls in the direction of the rear door, a floor extending between the sidewalls and forwardly from the rear door, a hopper means lying between the floor and the front end wall, a movably mounted sheet having first and second positions, in the first position the sheet lying between the side walls, covering the hopper means, and in the second position the sheet being supported on the support between the side walls, sloping downwardly in the direction of the front end wall, between the hopper means and the rear door; wheel means mounted beneath the container and supporting the container; towing connection means pivotally connecting the tractor and the container; and tilt means mounted between the towing connection means and the container, for tilting the container between a tilted and a substantially horizontal position; whereby, the hopper means may be employed to discharge dry bulk goods when the sheet is in the second position and the container is in the substantially horizontal position, and the rear door may be employed to discharge dry bulk goods or piece goods with the sheet in the first position and the container in the tilted position, and the rear door may be employed to allow piece goods to be carried off with the sheet in the first position and the container in the substantially horizontal position.

In accordance with another aspect of the present invention there is provided a vehicle supporting mechanism for use in a vehicle having a container, and a rear wheel assembly defining left and right support means, left and right cross beams, forward and rearward axles, and forward and rearward wheels, the support mechanism comprising left and right stops projecting downwardly from the container above the centreline of the left and right cross beams and the centre line of the rearward axle.

The container and vehicle may have removable securing means securing the sheet to the container in the first position and in the second position.

The container may have supporting guide rails beneath the second position of the sheet, and support flanges beneath the first position of the sheet.

A transverse pocket may be provided below the front end wall and above the hopper means to locate the sheet in the first position.

The sheet may have support means on its underside.

The invention may be designed to be relatively easily maintained as there are few moving components and the components may be manufactured from strong, durable materials. Apparatuses embodying the present invention may be of fairly simplistic design for ease of manufacture. The apparatuses may be further designed for simplicity of use.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DETAILED DESCRIPTION OF THE PREFERRED EMBODIMENT

Figure 1:
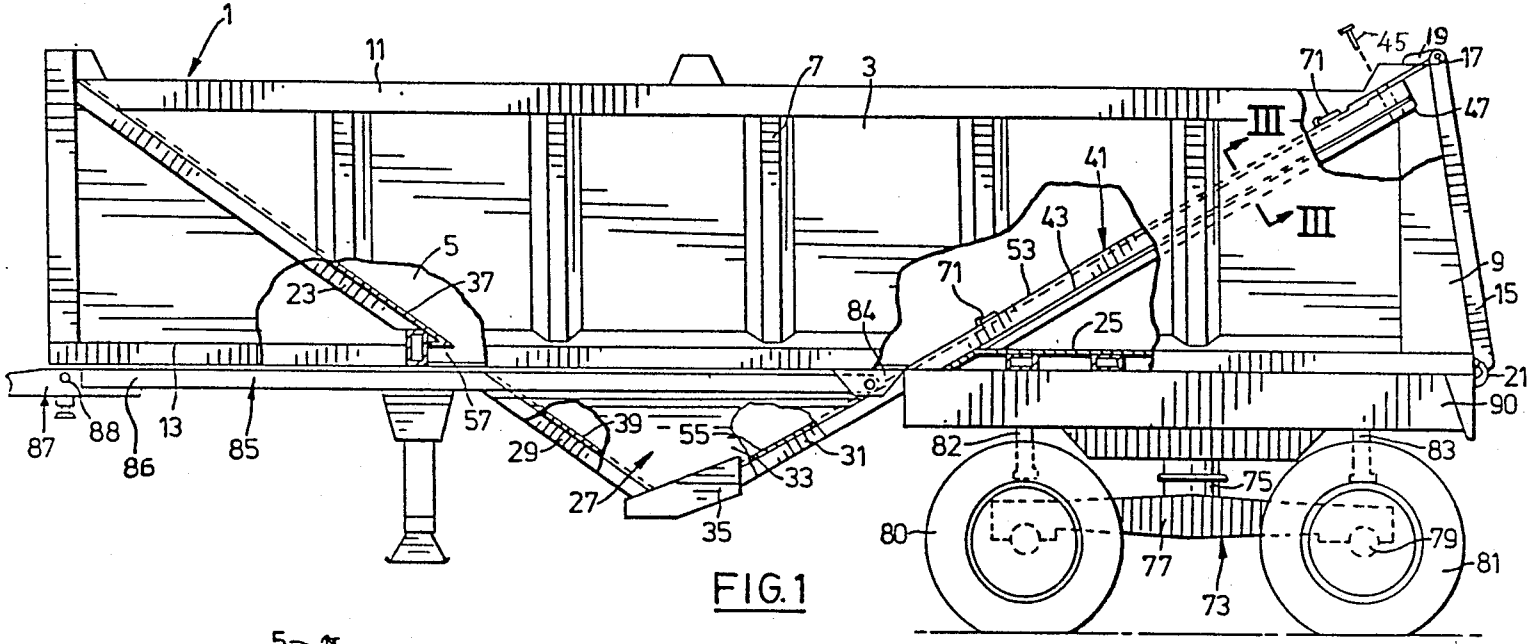
FIG. 1 is a partially cut away side elevation view of a container embodying the present invention with the sheet in the second position.

Reference will now be made to FIG. 1 which illustrates a cargo container 1 having left and right side walls, 3 and 5. The side walls are reinforced by side posts 7, rear posts 9, top sills 11 and bottom frame assembly 13.

A rear door 15 or tail gate 15 lies across the rear end of the side walls 3 and 5 against the rear posts 9. The tail gate 15 pivots about pivot pins 17 connected to a tail gate hinge 19. The rear posts 9 are sloped downwardly and rearwardly to encourage the tail gate 15 to rest positively against the rear posts 9. The tail gate 15 may be pivoted fully to rest on the top sills 11 of the container 1. This allows for maximum access to the interior of the container 1.

The tail gate 15 may be locked in position against the rear posts 9 by tail gate trip assembly 21.

A front end wall 23 slopes downwardly in the direction of the tail gate 15. Portions of the front end of the container forward of the front end wall 23 not used as structural support members may be removed to lessen the weight of the container 1. A floor 25 commences at the tailgate 15 and runs substantially horizontally toward the front end wall 23.

A gated hopper 27 lies between the floor 25 and the front end wall 23. The hopper 27 comprises sloped front and rear ramp portions 29 and 31, respectively, hopper sides 33 and a gate 35. The hopper sides 33 are secured to support flanges 61, so as to be stepped in from the side walls 3, 5. The front end wall has a top surface 37 and the front ramp 29 has a top surface 39. The top surfaces 37 and 39 lie at the same angle and are aligned to create a single slope at the front of the container 1.

A sheet 41 is shown in its sloped position. The sheet 41 is supported by sloping guide rails 43, mounted on the side walls 3 and 5, as is best shown in FIG. 3. The sheet 41 at its front end is bevelled and rests on top of the hopper 27 and on support flanges whose detail will be described later with reference to FIG. 2. The rear end of the sheet 41 rests on the top edge of the tailgate 15 providing support. Having the rear of the sheet 41 rest on the tailgate 15 also prevents bulk granular material which is filled from above from entering into the space beneath the sheet 41 in the sloped position where it could not be discharged through the hopper means 27.

The container 1 may be extended to have a greater length of floor 25 without otherwise changing the dimensions. This would leave a greater distance between the rear of the sheet 41 and the top of the tailgate 15. If the distance between the rear of the sheet 41 and the top of the tailgate 15 is matched to the height of the tailgate 15, the tailgate may be flipped approximately 270° to rest on the sills 11. The rear end of the sheet 41 may then rest on the bottom edge of the tailgate 15. This will again cover the volume under the sheet 41 in the sloped position.

Figure 5:
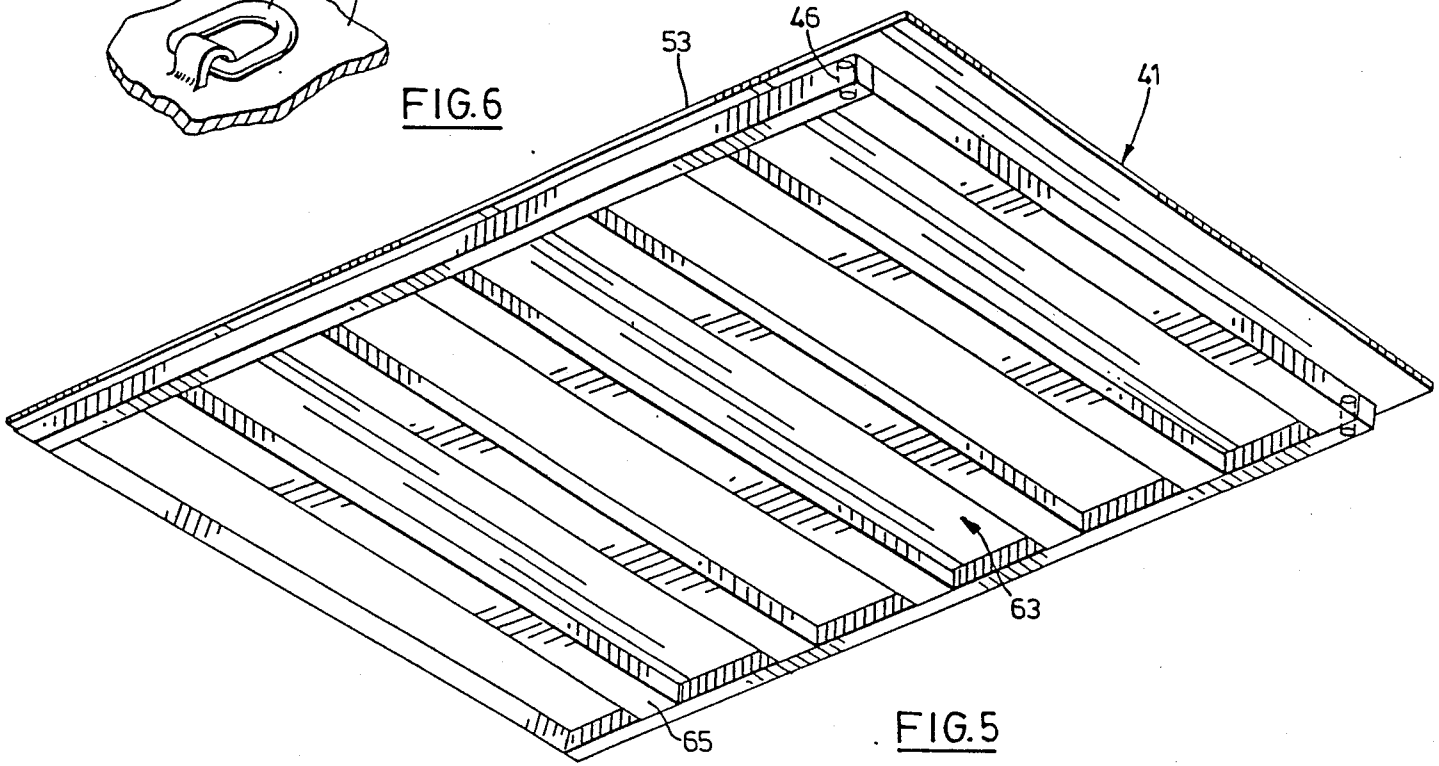
FIG. 5 is a perspective view from the underside of the sheet shown in FIGS. 1 and 2.

The sheet 41 at its rear end is held in the slope position by pins 45 on either side. The pins 45 fit throught sleeves 46 in the sheet 41. The sleeves 46 provide openings through the sheet 41 as is best shown in FIG. 5. The pins 45 further fit through openings in the guide rails 43 and rest in snug fitting openings in blocks 47 secured beneath the guide rails 43 as shown in FIG. 3.

The sheet 41 has a top surface 53 and the rear ramp 31 of the hopper 27 has a top surface 55. Each of the top surfaces 53 and 55 is aligned with the other to form a continuous slope when the sheet 41 is in the sloped position.

The gate 35 is pivotally connected to the rear ramp 31.

Reference will now be made to FIG. 5 which depicts the sheet 41 from its underside. The sheet 41 has reinforcing bracing members 65 on its underside 63. Sleeves 46 provide openings through bracing members 65 and the top surface 53. The front edge of the sheet 41 is bevelled as mentioned earlier.

The sheet 41 is preferably manufactured from steel, as are the rest of the container components. The sheet top surface 53 is formed from a sheet steel plate and the bracing members 65 can be rectangular section steel tubes.

Figure 2:
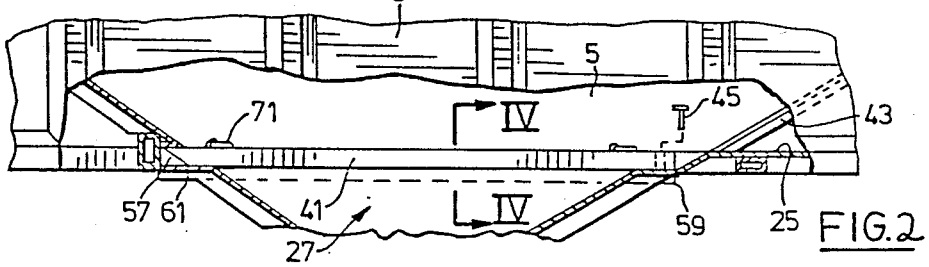
FIG. 2 is a partially cut away partial side view of the container shown in FIG. 1 on a larger scale with the sheet in the first position.
Figure 3:
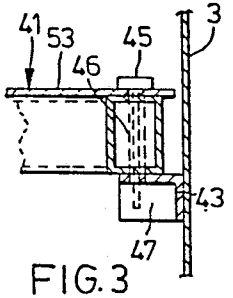
FIG. 3 is a partial sectional view on a larger scale, along the lines III—III shown in FIG. 1.
Figure 6:
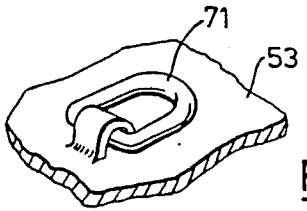
FIG. 6 is a perspective view on a larger scale of a portion of the top side of the sheet shown in FIGS. 2 and 5.

At either end and near the center of the sheet 41 on its top surface 53 are provided two lift rings 71 as shown in FIGS. 1 and 2 and detailed in FIG. 6.

Figure 4:
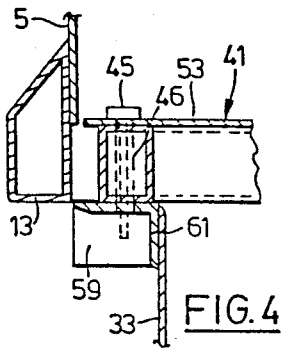
FIG. 4 is a partial sectional view on a larger scale, along the lines IV—IV shown in FIG. 2.

Reference will now be made to FIG. 2 which depicts the sheet 41 in its position substantially planar with the floor 25. The front end of the sheet 41 fits into a pocket 57 between the front end wall 23 and the front ramp 29. A cross member 58 defines the end of the pocket 57. The pins 45 again fit through the sleeves 46 and then through openings in the support flanges 61 to rest in snug fitting openings in blocks 59 beneath the support flanges 61 as shown in FIG. 4. When the sheet 41 is in the sloped position the openings in the flanges 61 the blocks 59 are covered preventing them from becoming blocked with granular material.

In the substantially planar position the sheet 41 rests on support flanges 61 mounted beneath the frame assembly 13 and beside and above the hopper sides 33, as is best shown in FIG. 4. The rear end of the sheet 41 rests on the floor 25 to provide support and to prevent bulk material from entering the hopper 27

Referring again to FIG. 1, the rear portion of the container 1 rests on a wheel assembly 73 of known configuration, for example a Chalmer's wide frame suspension unit. The wheel assembly 73 comprises shock absorbing and support units 75 resting on cross beams 77. The ends of the beams 77 rest on axles 79 running perpendicular to the beams 77. The axles 79 are provided with forward and rearward wheels 80 and 81.

Fixed to the underside of the container 1 are forward and rearward support stops 82 and 83. The stops 82 and 83 project downwardly, their lower ends lying above the points at which the centre lines of the axles 79 cross the centre lines of the beams 77. The undersides of the stops 82 and 83 are bevelled.

Figure 7:
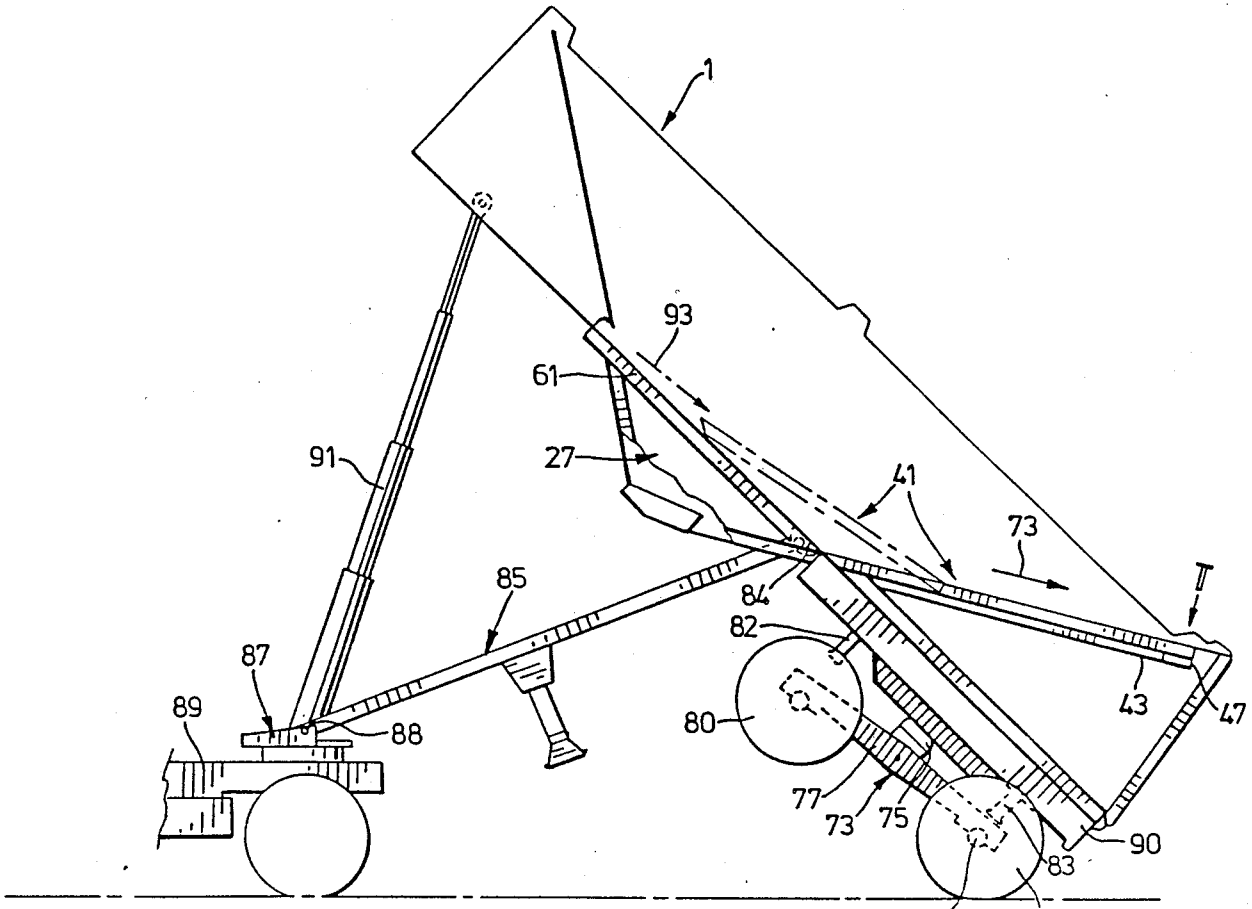
FIG. 7 is a diagrammatic side view of a vehicle embodying the present invention.

Referring again to FIG. 1, there are shown mounting brackets 84 deposed on the underside of the frame assembly 13 on either side of the container 1. Pivotally connected to the mounting brackets is a draft arm assembly 85. The draft arm assembly 85 comprises left and right draft arms 86. The draft arms 86 run toward the front of the container 1 around the hopper 27 then angle toward one another until they meet a fifth wheel plate assembly 87. The draft arms 86 are pivotally connected around pivot pins 88 to the plate assembly 87. The plate assembly 87 is adapted to pivotally connect the container 1 via the draft arm assembly 83 to a tractor 89 as shown in FIG. 7.

It will be noted that the invention is described with reference to a preferred embodiment which employs a frameless container 1. Frameless containers require little or no support structure. A frame assembly 90 is shown beneath the floor 25 due to the substantial load there, but no frame exists between the front end of the floor 25 and the front of the container 1. Although the invention is being described with reference to a frameless vehicle as the prefered embodiment it should be understood that the invention is not limited to use in association with a vehicle of the frameless type.

A lift cylinder 91 is pivotally mounted on the plate assembly 87 and pivotally connected to the container 1 beneath the front end wall 23.

A roof, not shown, may be disposed over the top sills 11 and between the left and right side walls, 3 and 5 respectively. The roof may have ports through which the container 1 may be filled with bulk goods.

In operation, the container 1, with the sheet 41 in the sloped position as shown in FIG. 1, may be used to carry bulk goods. The bulk goods would enter the container 1 from above. The container 1 is connected to the tractor 89 and may be towed thereby. When the container is at its destination the bulk goods may be discharged through the hopper 27 by opening the gate 35.

To transport bulk goods and discharge them through the tail gate 15 the sheet 41 is mounted in the planar position as shown in FIG. 2. The goods are again loaded from above the container 1 and lie in the volume above the sheet 41 and the floor 25. The container 1 may be towed as before. To discharge bulk goods through the tailgate 15, the tail gate trip assembly 21 is unlatched. The lift cylinder 91 tilts the front end of the container 1 while the draft arm assembly 85 retains the rear end of the container 1. The tail gate 15 pivots on the pivot pin 17 of the tail gate hinge 19. As the lift cylinder 91 raises the front end of the container 1, the draft arm assembly 85 pivots in the mounting brackets 84 and actually pulls the rear of the container 1, which rests on the most rearward wheels 81 of the wheel assembly 73, toward the tractor 89. The bulk goods slide by gravity action from the interior of the container 1 through the tail gate 15.

During tilting the stops 83 come into contact with the beams 77 as will be later described. Piece goods suitable for dumping such as strapped lumber, may be loaded and dumped in a manner similar to that just described.

In order to carry and off-load piece goods not suited to dumping, the sheet 41 is mounted in the planar position as before. During off-loading the tail gate 15 is swung to its fullest extent on the pivot pin 17 to rest above the container 1 allowing for open access to the interior of the container 1.

To slide the sheet 41 back into the sloped position from the planar position, the container 1 is put into a substantially horizontal position and the pins 45 are removed from the blocks 59. The lift cylinder 91 raises the container 1 into the tilted position as described previously. The sheet 41 slides rearwardly onto the guide rails 43 from the support flanges 61 as shown by the ghosted sheet 41 and the arrows 93. As there can be a great deal of friction between the sheet 41 and the guide rails 43, it may be necessary to manipulate the sheet 41 into the proper position for placing the pins 45 through the sleeves 46 and the flanges 61 into the blocks 59 by connecting a pulling device to the left rings 71.

To move the sheet 41 from the slope position to the planar position, the container 1 is lifted into the tilted position as described previously. When the sheet is substantially horizontal the pins 45 may be relatively easily removed from the blocks 59. The lift cylinder 91 is then lowered. As the container 1 moves downward the sheet 41 begins to slide on the guide rails 43. As the sheet 41 leaves its position of resting on the floor 25, the front end of the sheet 41 moves onto the support flanges 61. Thus, the front end of the sheet 41 rests on support flanges 61 while the rear end of the sheet 41 rests on the guide rails 43. As the lift cylinder 91 lowers further, the sheet 41 will slide into the pocket 57 coming to rest completely on the support flanges 61 above the hopper 27. To lock the sheet 41 into position the pins 45 are placed through the sleeves 46 and the rails 43 into the blocks 47.

The sheet 41 is placed in the container 1 and removed from the container 1 when necessary by hoisting it on the lift rings 71.

The use of a minimal number of movable components preferably formed from a strong, durable material such as steel makes the container 1 relatively easy to maintain, manufacture and operate.

When the lift cylinder 91 raises the front end of the container 1 the front wheels 80 of the wheel assembly 73 will come off the ground. The full load at the rear of the container is resting on the rear wheels 81. This situation causes the cross beams 77 to pivot on the supports 75, tending to snap the supports 75. This is extremely hard on the supports 75 and may ultimately cause them to fail. To take a portion of the load from the support 75 the stops 83 come into contact with the tops of the beams 77 just above the centre line of the axle 79. The bottoms of the stops 83 are bevelled to maintain a maximum contact between the stops 83 and the beams 77 when the beams 77 are partially pivoted with respect to the container 1. The stops 83 prevent the beam 77 from pivoting excessively on the support 75 and carry some of the load from the container 1. The forward and rearward stops 82 and 83 are further used to ensure the wheel assembly 73 is not rotated, either clockwise or counterclockwise, while moving, to such an extent that the supports 75 may fail. Such rotation may be caused by unusual road conditions including potholes.

While the present invention has been disclosed in connection with the preferred embodiment thereof, it should be understood that there may be other embodiments which fall within the spirit and scope of the invention as defined by the following claims.

It is to be understood that this invention can be manufactured of steel or aluminum in part or in whole.

I claim:

1. A convertible cargo container, comprising: sidewalls; a rear door movably mounted between the sidewalls; a front end wall extending between the sidewalls and sloping downwardly in the direction of the rear door; a floor extending between the sidewalls and forwardly from the rear door; a hopper means mounted between the floor and the front end wall; a support means on the sidewalls for supporting a sheet above the floor; and a movably mounted sheet having first and second positions, in the first position the sheet lying between the sidewalls, covering the hopper means, and in the second position the sheet being supported on the support means between the sidewalls, sloping downwardly in the direction of the front end wall, and between the hopper means and the rear door.

2. The container of claim 1, further comprising, removable securing means for securing the sheet to the container in the first position and in the second position.

3. The container of claim 2 wherein the support means comprises a supporting guide rail on the interior of each sidewall beneath the second position of the sheet.

4. The container of claim 3 further comprising support flanges stepped in from the respective sidewalls, between the hopper means and the sidewalls, supporting the sheet in the first position.

5. The container of claim 4, further comprising a pocket means extending transversely below the front end wall and above the hopper means into which the forward edge of the sheet can slide.

6. The container of claim 5 wherein the rear door is pivotally mounted at its top end between the sidewalls and the rear door is spaced from the support means such that a rear edge of the sheet rests on the top edge of the rear door in the second position.

7. The container of claim 5 wherein the rear door is pivotally mounted at its top edge to the sidewalls and such that the rear door can be pivoted to lie on top of the sidewalls and the rear door is spaced from the support means such that a rear edge of the sheet rests on a bottom edge of the rear door when the rear door lies on top of the side walls.

8. The container of claim 5, 6 or 7, wherein the securing means further comprises a plurality of pins, a plurality of openings in the sheet and a plurality of corresponding openings in the guide rails and in the flanges, the pins being engagable with the openings in the sheet and either openings in the flanges to secure the sheet in the first position or openings in the guide rails to secure the sheet in the second position.

9. The container of claim 4, wherein the sheet comprises a plate, and an underside support frame secured to the plate.

10. The container of claim 9, wherein the securing means further comprises a plurality of pins, a plurality of openings in the sheet extending into the support frame thereof, and a plurality of corresponding openings in the guard rails and the flanges, the pins being engagable with the openings in the sheet and either openings in the flanges to secure the sheet in the first position or openings in the guide rails to secure the sheet in the second position.

11. The container of claim 10, wherein the sheet includes sleeves defining the openings in the sheet, and the openings in the guide rails and the flanges are provided in blocks secured to the guide rails and the flanges.

12. The container of claim 11, wherein the front edge of the sheet is bevelled, and a transverse pocket is provided between the front end wall and the hopper means.

13. The container of claim 9, 10, 11, or 12, wherein the underside support frame comprises substantially rectangular tubes.

14. The container of claim 10 or 11, wherein the underside support frame comprises substantially rectangular tubes, and wherein the sleeves are provided in the rectangular tubes.

15. The container of claim 10 wherein the hopper means includes inclined forward and rear ramps, and wherein the top surface of the front end wall is substantially co-planar with the top surface of the forward ramp of the hopper means, and the top surface of the sheet is substantially co-planar with the top surface of the rear ramp of the hopper means, when the sheet is in the second position.

16. A convertible vehicle for use with dry bulk goods and/or piece goods, comprising: a tractor; a convertible cargo container defining sidewalls, a rear door movably mounted between the sidewalls; a front end wall sloping downwardly from the front of the sidewalls in the direction of the rear door, a floor extending between the sidewalls and forwardly from the rear door, a hopper means mounted between the floor and the front end wall, a support means on the sidewalls for supporting a sheet above the floor, a movably mounted sheet having first and second positions, in the first position the sheet lying between the sidewalls, covering the hopper means, and in the second position the sheet being supported on the support means between the sidewalls, sloping downwardly in the direction of the front end wall, between the hopper means and the rear door;

wheel means mounted beneath the container and supporting the container;

towing connection means pivotally connecting the tractor and the container; and tilt means mounted between the towing connection means and the container, for tilting the container between a tilted and a substantially horizontal position;

whereby, the hopper means may be employed to discharge dry bulk goods when the sheet is in the second position and the container is in the substantially horizontal position, and the rear door may be employed to discharge dry bulk goods or piece goods with the sheet in the first position and container in the tilted position, and the rear door may be employed for all piece goods to be carried off, with the sheet in the first position and the container in the substantially horizontal position.

17. The vehicle of claim 16, further comprising, removable securing means securing the sheet to the container in the first position and in the second position.

18. The vehicle of claim 17 wherein the support means comprises a supporting guide rail on the interior of each side wall beneath the second position of the sheet, and the container further comprises support flanges stepped in from the respective sidewalls between the hopper and the sidewalls, supporting the sheet in the first position.

19. The vehicle of claim 18, further comprising a pocket means lying below the front end wall and above the hopper into which the forward edge of the sheet can slide.

20. The vehicle of claim 19, wherein the sheet further comprises underside support means.

21. The vehicle of claim 20 wherein the securing means further comprises a plurality of pins, a plurality of openings in the sheet and a plurality of corresponding openings in the guide rails and the flanges, the pins being engagable with the openings in the sheet and either openings in the flanges to secure the sheet in the first position or openings in the guide rails to secure the sheet in the second position.

22. The vehicle of claim 21 wherein the front edge of the sheet is bevelled and the support means further comprises substantially rectangular tubes.

23. The vehicle of claim 22 wherein the top surface of the front end wall is substantially planar with the top surface of the forward ramp of the hopper means, and the top surface of the sheet is substantially planar with the top surface of the rear ramp of the hopper means, while the sheet is in the second position.

24. The vehicle of claim 16 wherein the wheel means comprises left and right cross beams, and forward and rearward axles and wheels, the vehicle further comprising a support mechanism defining left and right stops projecting downwardly from the container above the centrelines of the left and right cross beams and the centreline of the rearward axle whereby the container may be supported when the container is in the tilted position.

25. The vehicle of claim 24, wherein the stops are bevelled.

26. The vehicle of claim 16 further comprising bevelled left and right stops projecting downwardly from the container above the centrelines of the left and right beams and the centreline of the forward axle.

* * * * *